US006220819B1

(12) United States Patent
Chien et al.

(10) Patent No.: US 6,220,819 B1
(45) Date of Patent: Apr. 24, 2001

(54) CENTRIFUGAL PUMP IMPELLER

(75) Inventors: Huan-Jan Chien; Pao-Yin Ou, both of Hsinchu; Shu-Fen Kao, Taipei; Jing-Fuh Chen, ChangHua, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/481,378

(22) Filed: Jan. 12, 2000

(51) Int. Cl.[7] ..... B63H 1/16
(52) U.S. Cl. ..... 416/186 R; 416/235
(58) Field of Search ..... 416/186 R, 223 R, 416/228, 235, 237

(56) References Cited

U.S. PATENT DOCUMENTS 751,315 * 2/1904 Lindmark ..... 416/185
1,032,287 * 7/1912 Kreher ..... 416/181
1,983,201 * 12/1934 Rijswijk ..... 416/186 R
3,260,443 * 7/1966 Garnett et al. ..... 416/182
3,298,444 * 1/1967 Haas ..... 416/186 R
3,368,744 * 2/1968 Jenn ..... 416/237
4,236,871 * 12/1980 Hirst et al. ..... 416/186 R
5,707,209 * 1/1998 Iyer et al. ..... 416/186 R

* cited by examiner

*Primary Examiner*—John E. Ryznic
(74) *Attorney, Agent, or Firm*—Dougherty & Troxell

(57) ABSTRACT

A centrifugal pump impeller for easy positioning and avoid producing turbulence, includes a hub, a rear cover plate engaged with the hub, a front cover plate having an inlet at a front end thereof, and a plurality of vanes. Each vane has a front blade engaged with the front cover plate, a rear blade engaged with the rear cover plate and a blade to bridge the front and rear blade. The front blade has an indent section adjacent the inlet so that the front end of the front blade wont extend outside the front cover plate when the vane engages with the front cover plate. The rear blade has a curved front edge adjacent the spindle to make closed contact with the hub. The indent section and the curved front edge enable the impeller has smooth surface at the inlet without producing turbulence. The front and rear ends of the rear blade have respectively a vane balance hole and a positioning hole for the vane to be positioned between the front and rear cover plates precisely and easily.

15 Claims, 6 Drawing Sheets

CENTRIFUGAL PUMP IMPELLER

BACKGROUND OF THE INVENTION

1. Field of the Invention

This invention relates to a centrifugal pump impeller and particularly to an impeller that can prevent turbulence at the inlet of the pump for improving pumping efficiency and enables accurate positioning of the vane for the impeller.

2. Description of the Prior Art

In the design and fabrication of impeller for centrifugal pump, how to improve pumping efficiency of the vane and to make positioning of the vane simple in the assembly are some of the heavily focused issues. The surface smoothness at the inlet of the impeller may directly affect flow streamline in the passage and pumping efficiency. To avoid forming abrupt surface change at the impeller inlet is one of the key design consideration. As an impeller usually has at least six blades and each blade is formed in an irregular spiral shape, to accurately position the blades for assembling the vane is not easy. When the blades are not accurately-positioned, the pumping efficiency will be negatively impacted.

Furthermore conventional rear vane cover plate of the pump usually is made by pressing. The cover plate has relatively large size and may result in lower structural strength. It also tends to form corrugation (with rough surface). This phenomenon happens most often to an impeller (or pump) with smaller specific speed. Conventional technique uses increased vane cover plate thickness to enhance strength and employs high cost machining work to further improve cover plate precision. It increases cost and drags down fabrication efficiency.

Some improvement techniques have been announced to address these issues. U.S. Pat. No. 5,082,425 discloses a technique that forms a plurality of corrugation structure on the vane cover plate mating with the vane base to facilitate the blade positioning in the impeller. The corrugation structure needs elaborated design and high precision machining, and also needs accurate soldering work to put the blades in place. The design and fabrication are expensive. Moreover the vanes at the inlet side still cannot totally align with the front end of the hub and suction port. As a result, a not smooth surface will be formed for the vane around the hub and suction port at the inlet area. Flowing fluid easily produces turbulence at this area and greatly impact pumping efficiency.

German Pat. No. DE 44 46 193 C2 discloses another impeller structure that has a plurality of thin spiral vanes soldering to the front and rear vane cover plate by means of laser soldering operation. It may improve surface smoothness of the vane at the inlet and reduce turbulence. However laser soldering operation costs higher, and the blade positioning problem remains unresolved.

SUMMARY OF THE INVENTION

In view of aforesaid disadvantages, it is therefore an object of this invention to provide a centrifugal pump impeller that has smooth surface at the inlet for reducing turbulence and enhancing pumping efficiency. It has simpler structure and costs lower to produce. The vane may be accurately positioned easily.

The pump impeller according to this invention includes a hub, a rear cover plate engaged with the hub, a front cover plate having an inlet and a plurality of vanes. Each vane has a front blade engaged with the front cover plate, a rear blade engaged with the rear cover plate and a blade bridges the front and rear blades. The vanes are located between the front and rear cover plates to form a plurality of spiral pumping passages. The impeller has the following characteristics:

The front blade adjacent the inlet has an indent section which does not extends out of cover plate at the inlet circumference. During pumping operation, fluid may flow into the impeller through the inlet smoothly without producing resistant flow.

The rear blade adjacent the pump spindle has a curved front edge mating closely with the impeller rim for initial positioning use. It also helps to make the vane passage smooth at the inlet around the hub for preventing turbulence. The rear blade has a vane balance hole formed at a front end close to the curved edge mating with a balance hole formed in the rear cover plate. The rear blade further has a positioning hole formed at a rear end thereof. Through these features, the vane may be accurately and easily positioned between the front and rear cover plates. It costs lower and is easier to fabricate and assemble.

In one aspect of this invention, the curved front edge of the rear blade further has a radial cutting edge located at a side remote from the blade. During vane positioning, the cutting edge is extending radially along the spindle. The front tip of the curved front edge of a rear vane (which has a radial cutting angle) may be close to the radial cutting edge of a front vane for preventing turbulence.

In another aspect, the rear cover plate has an outer fold rim formed by pressing that may enhance structural strength with greater precision and avoid the formation of corrugation at the outer rim of the rear cover plate.

It still another aspect, there is a rear sealing ring engaged between the rear cover plate and the impeller. The rear sealing ring has a ring balance hole mating against the rear cover plate balance hole. The rear sealing ring further has teeth-shaped inner ring formed by pressing for engaging with the hub for enhancing the axial alignment and bonding accuracy of the rear sealing ring with he spindle.

BRIEF DESCRIPTION OF THE DRAWINGS

This invention, as well as its many advantages, may be further understood by the following detailed description drawings in which.

DETAILED DESCRIPTION OF THE PREFERRED EMBODIMENT

Figure 1:
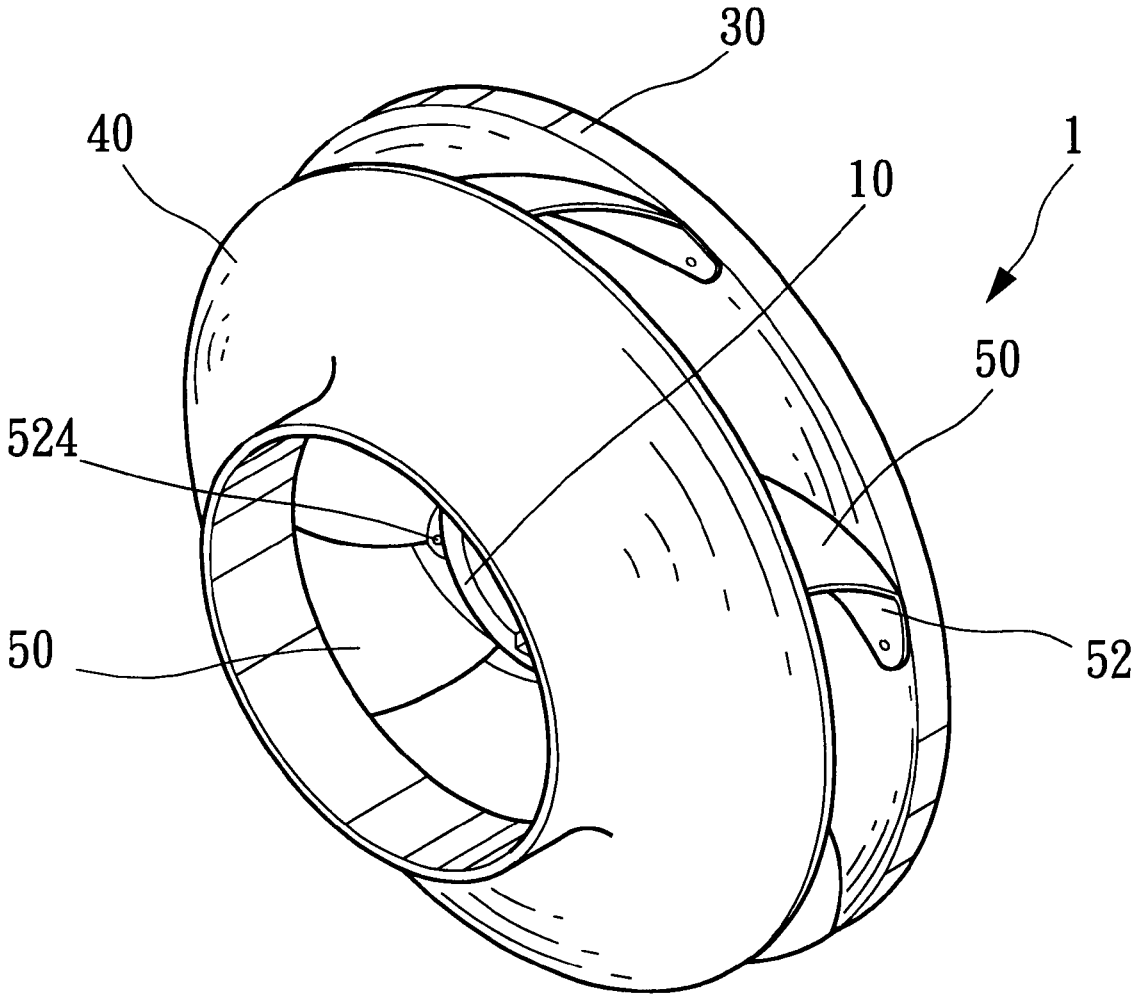
FIG. 1 is a perspective view of a centrifugal pump impeller of this invention.
Figure 2:
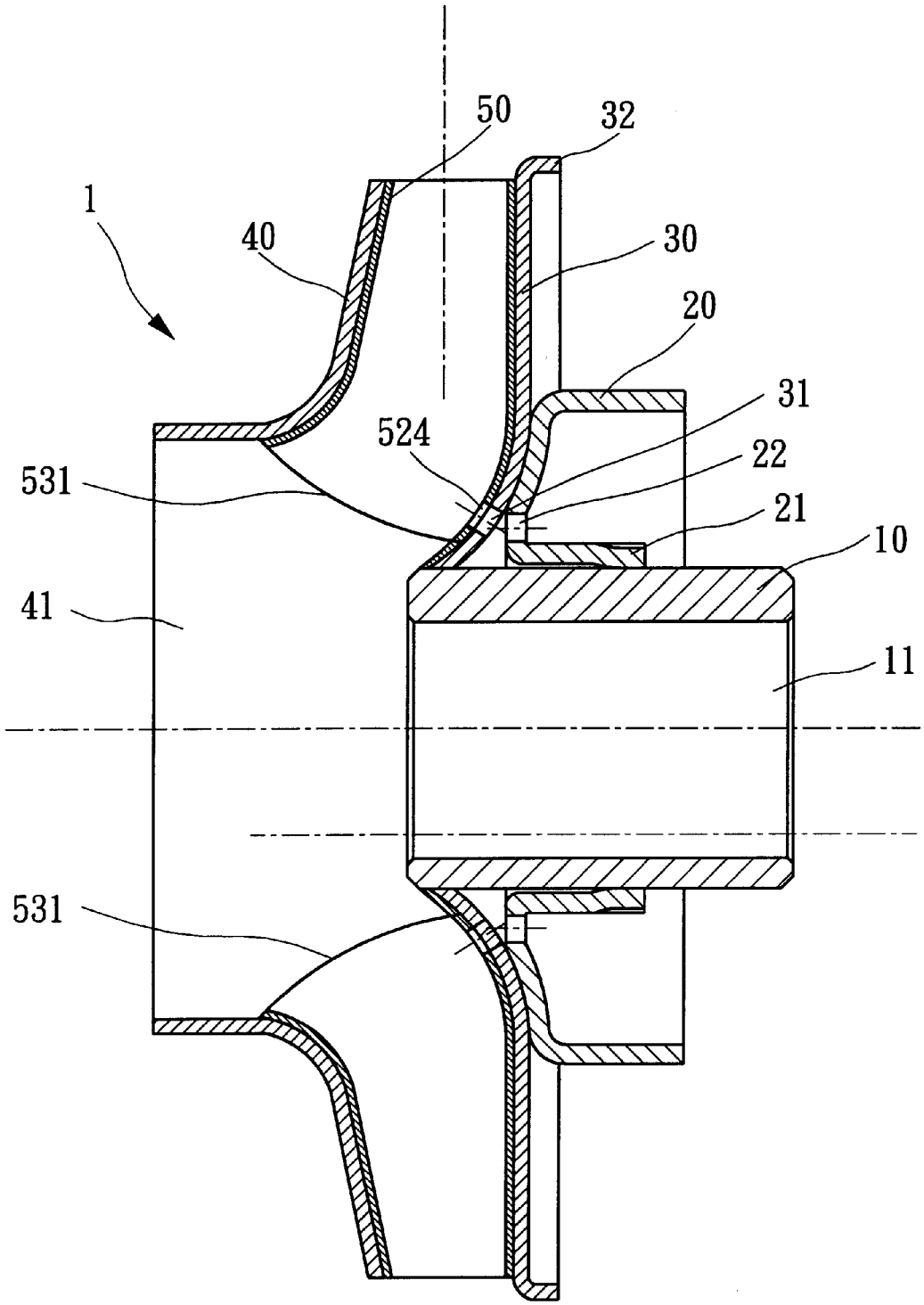
FIG. 2 is a sectional view of the impeller shown in FIG. 1.
Figure 3:
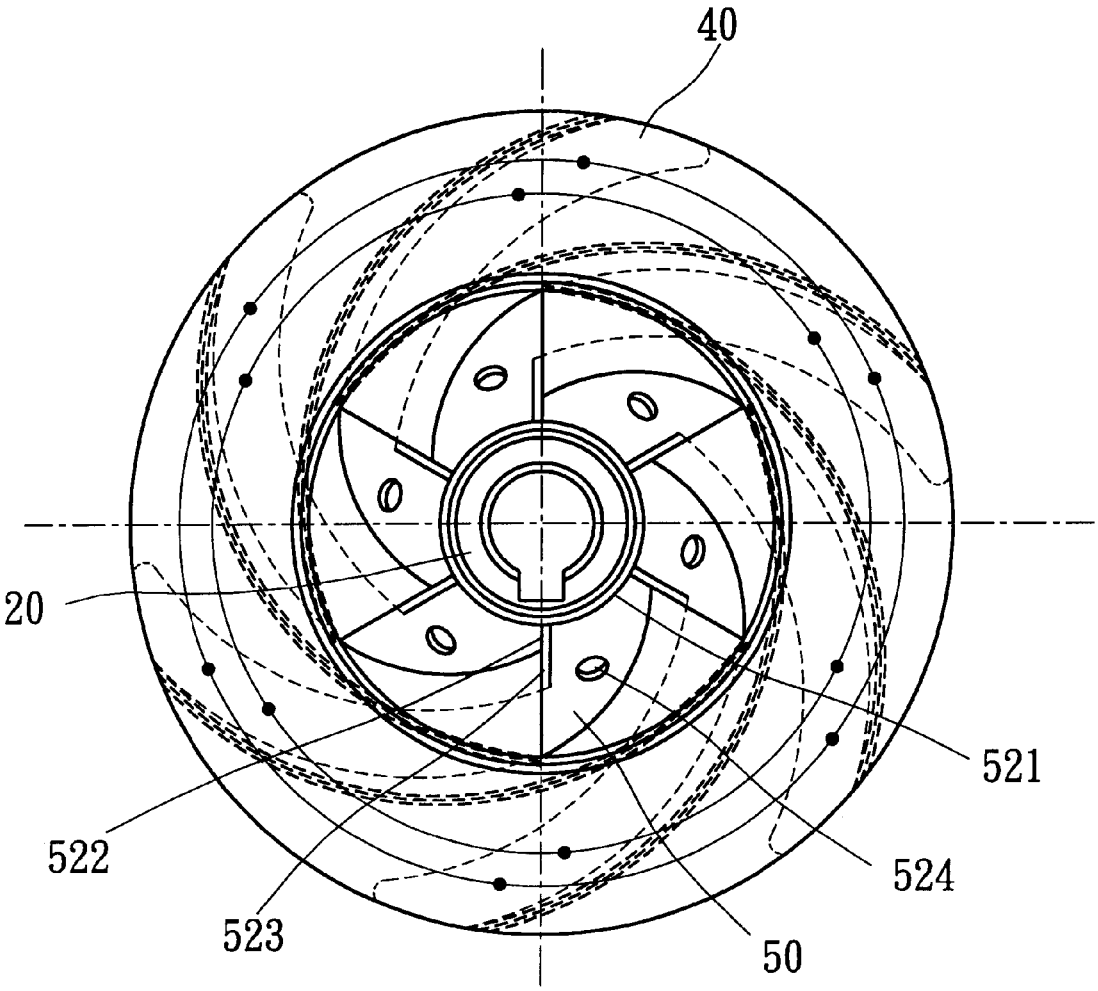
FIG. 3 is a top view of the impeller shown in FIG. 1.

Referring to FIGS. 1, 2 and 3, the impeller 1 according to this invention may be housed in a pump casing (also not shown in the figures) for pumping fluid. The impeller 1 includes a hub 10, a rear cover plate 30, a rear sealing ring 20, a front cover plate 40 and a plurality of vanes 50. At the front end of the front cover plate 40, there is an inlet 41. The rear cover plate 30, rear sealing ring 20, front cover plate 40 and the vanes 50 are preferably made by pressing, or by casting or CNC machining. After the components are made, they are bonded together by soldering or adhering to form the impeller.

The impeller has a shaft hole 11 which may be fixedly engaged with the spindle (not shown in the figures) by means of a key (also not shown) and may be driven to rotate by the spindle.

The rear cover plate 30 is engaged with the hub 10 and has a plurality of balance holes 31 formed therein at selected locations to balance the fluid pressure between the front and rear sides (i.e., left and right side in FIG. 2). At the outer rim of the rear cover plate 30, an outer fold rim 32 is formed by pressing to avoid the corrugation taking place at the outer rim and to enhance structural strength and dimensional precision. The pressing takes two process steps. The first step pressing is to form the rear cover plate 32 without the outer fold rim 32. The second step pressing is to form the outer fold rim 32. By the same taken, the front cover rim 40 may also be formed with an outer fold rim, although it is not shown in FIG. 2.

Figure 6:
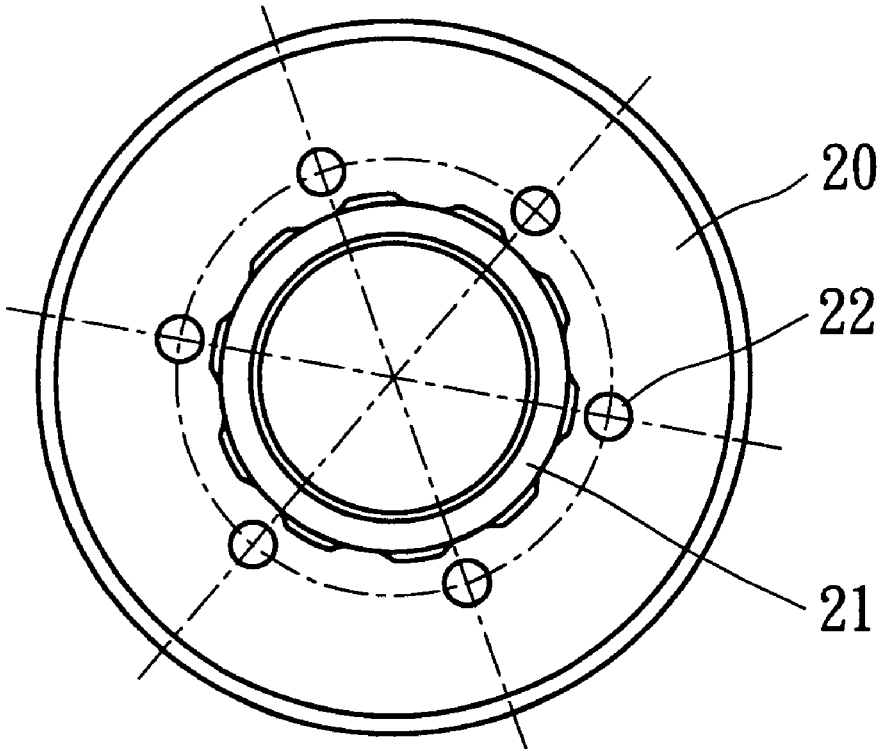

The rear sealing ring 20 is mounted on the hub 10 and behind the rear cover plate 30. It may have a teeth shaped inner ring 21 (shown in FIG. 6) to facilitate engagement with the hub 10. The rear sealing ring 20 may also have a plurality of ring balance holes 22 mating against the rear cover plate holes 31 to enable fluid to pass through. The rear sealing ring 20 also may be made by two step pressing (with the first step pressing to form the main body, and the second step pressing to form the teeth structure in the inner ring 21). It thus may get accurate dimension to make precise positioning with the hub 10. The teeth structure in the inner ring 21 helps to make precise axial alignment of the rear sealing ring 20 with the spindle. It also helps to maintain radial vertical alignment of the vane outlet against the spindle. As a result, it helps to improve pumping efficiency. The vane is located between the front and rear cover plate 40 and 30 and forms a plurality of spiral fluid passages in the space between the cover plates 40 and 30. Each vane has a front blade 51 engaged with the front cover plate 40, a rear blade 52 engaged with the rear cover plate 30 and a blade 53 bridges the front and rear blades 51 and 52 to become a Z shape (or reverse Z shape) structure.

Figure 4:
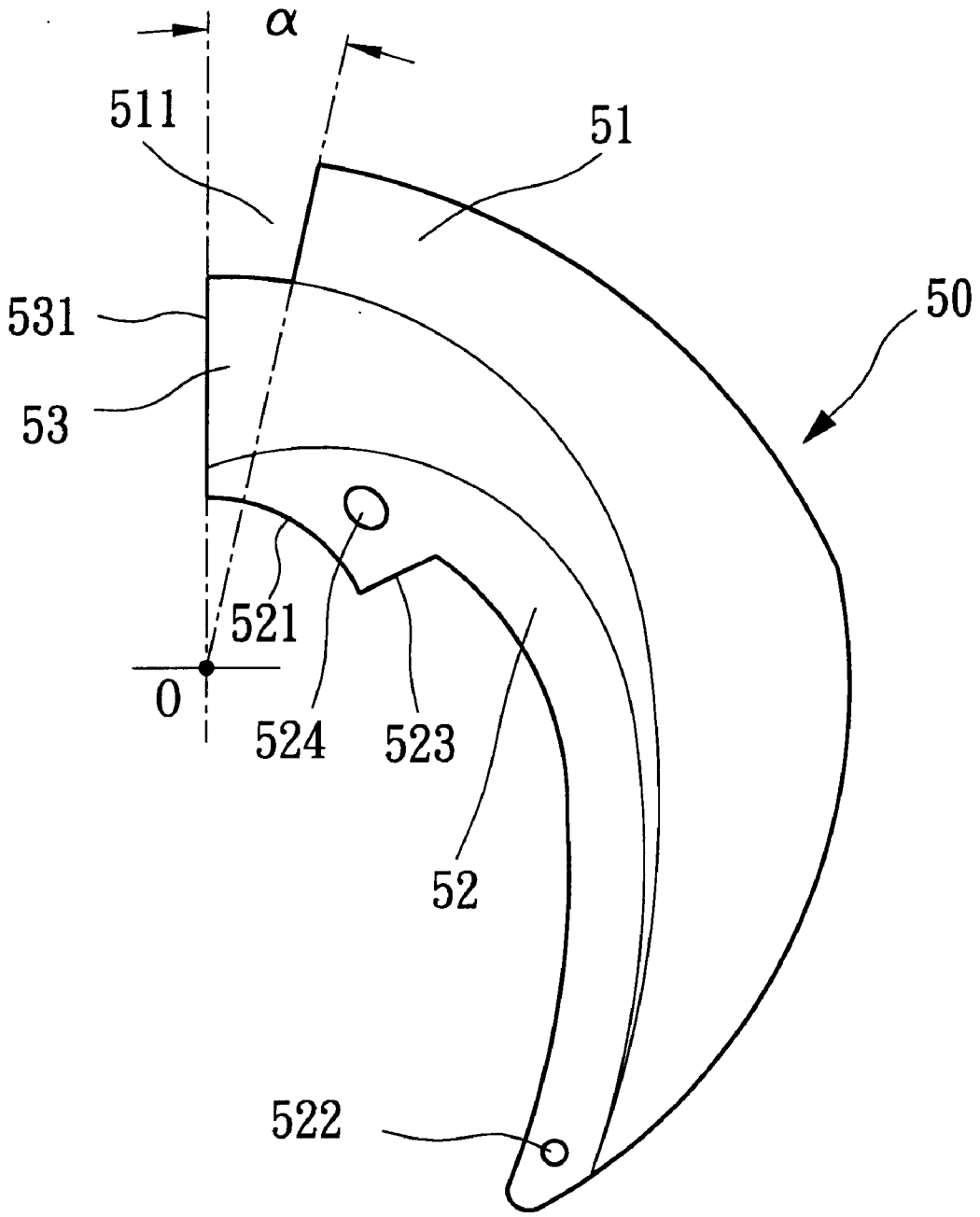
FIG. 4 is a top view of a vane of this invention.
Figure 5:
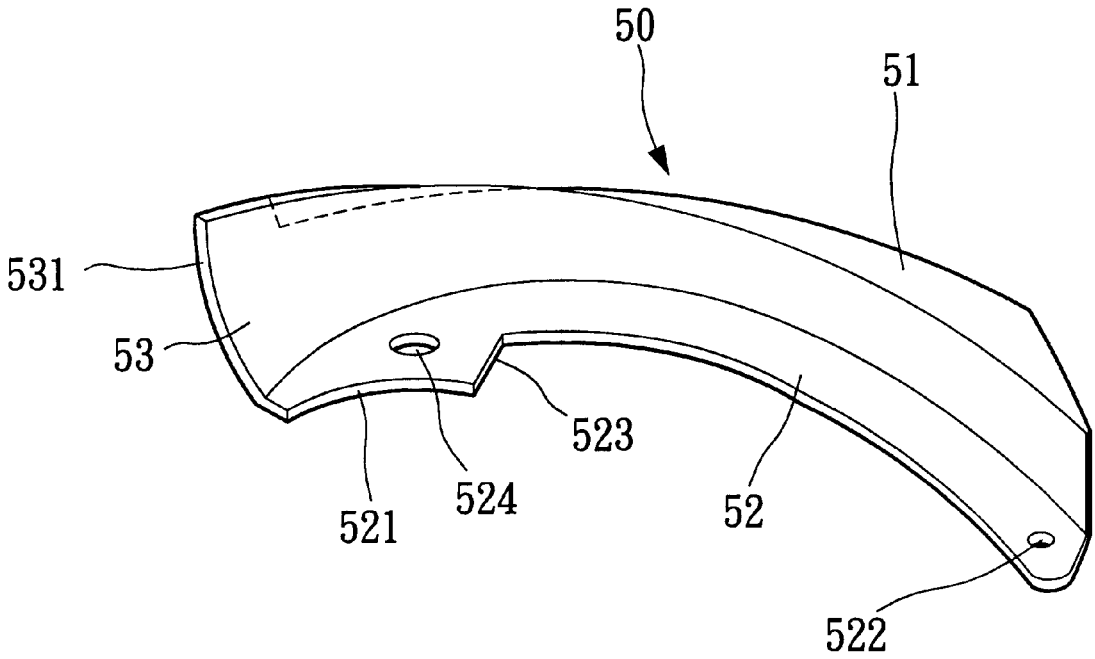
FIG. 5 is a perspective view of a vane shown in FIG. 4.

Referring to FIGS. 4 and 5, the rear blade 52 has a curved front edge 521 and a radial cutting edge 523. The curved front edge 521 is generally mating the hub 10 surface and has a length to equally divide the hub 10 surface according to the number of the vane 50 (e.g., taking vane number for six, the length of the curved front edge 521 may cover the hub 10 surface at about sixty degree angle). Such a structure may be used for initial positioning and may make the impeller inlet have smooth plane around the hub 10 to prevent turbulence. At the curved front edge 521, there is further a vane balance hole 524 mating against the balance hole 31 in the rear cover plate 30. The rear blade 52 remote from the curved front edge 521 has a positioning hole 522. By means of the curved front edge 521 and the vane balance hole 524, the vane 52 may be positioned between the front and rear cover plate 40 and 30 accurately and easily.

For assembly the vane 50 and the rear cover plate 30, the vane balance hole 524 shall be aligned with the balance hole 31 (or by means of a pin, which is not shown in the figure, running through the positioning hole 522 and the vane balance hole 524). Then both sides of the vane 50 may be accurately positioned for the vane 50 to engage with the rear cover plate 30. The engagement work is simple and low cost.

The curved front edge 521 adjacent the blade front edge 531 of the blade 53 further has a radial cutting angle (unmarked). The radial cutting edge 523 is located at the curved front edge remote from the blade front edge 531. When the vanes 50 are positioned between the front and rear cover plate 40 and 30, the radial cutting angle of a rear vane may be closed to the cutting edge 523 of a front vane (as shown in FIG. 3). Such structure and arrangement may prevent interference and also make the vane inlet (i.e., the two ends of the blade front edge 531) have smooth plane around the spindle, and may prevent turbulence from happening.

Because of the presence of the vane balance hole 524, positioning hole 522, and the positioning features of the curved front edge 521 set forth above, the positioning and assembly of the vane 50 may be made easily with great accuracy. The component (such as the rear cover plate) structure becomes simpler. It thus may effectively overcome the problems existing in the conventional centrifugal pump impeller.

Furthermore, the front blade 51 adjacent the blade front edge 531 (or inlet 41) may have an indent section 511 which enables the front blade 51 not protruding out of the front cover plate 40 at the inlet 41. The juncture of the blade front edge 531 and the front cover plate 40 thus may form a smooth plane which allows fluid to flow smoothly through the inlet 41 into the impeller when the impeller is rotating for pumping. Turbulence and flow resistance may be greatly reduced. FIG. 4 shows the location and size of the indent section 511. It is preferably formed by two radial lines centered at the spindle and with an $\alpha$ angle of 10–30 degree.

In summary, the components of the impeller of this invention are simply shaped and designed. The forming of the vane balance hole 524, positioning hole 522, curved front edge 521 and radial cutting edge 523 make positioning and assembly of the vane 50 accurate and simple, and may greatly reduce turbulence. Fabrication is easy and low cost. The structure of indent section 511, curved front edge 521 and radial cutting edge 523 make the engagement juncture between the blade front edge 531 and the front cover plate 40 and the hub 10 front end smooth and may prevent turbulence and enhance pumping efficiency.

It may thus been seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skill in the art. Accordingly, the appended claims are intended to cover all embodiments which do not depart from the spirit and scope of the invention.

What is claimed is:

1. A centrifugal pump impeller for mounting on a rotationable spindle to pump fluid, comprising:

a hub;

a rear cover plate engaged with the hub;

a front cover plate having an inlet at a front end thereof; and a plurality of vanes engaged with the front and rear cover plate to divide a space between the front and rear cover plates into a plurality of spiral pumping fluid passages, each vane having a front blade engaged with the front cover plate, a rear blade engaged with the rear cover plate and a blade bridges the front blade and the rear blades;

wherein the front blade has an indent section adjacent the inlet so that when the front blade engages with the front cover plate the indent section won't protrude outside the front cover plate at the inlet portion to enable pumping fluid flowing smoothly through the inlet into the impeller without producing flow resistance and turbulence;

the rear blade closed to the spindle has a curved front edge adjacent outside surface of the hub, a vane balance hole formed at the curved edge, and a positioning hole formed at an end remote from the curved front edge, the rear cover plate has a balance hole mating against the vane balance hole, the positioning hole and vane balance hole enable the vanes be accurately and easily positioned between the front and rear cover plate.

2. The centrifugal pump impeller of claim 1, wherein the cured front edge has a radial cutting angle closed to the blade and a radial cutting edge remote from the blade, when the vanes being positioned between the front and rear cover plates, the radial cutting angle and edge are extending radially along the spindle, and the radial cutting angle of a rear vane is close to the radial cutting edge of a front vane.

3. The centrifugal pump impeller of claim 1, wherein the rear cover plate has a outer fold rim formed by pressing for preventing corrugation happened to outer rim of the rear cover plate and to enhance rear cover plate structural strength and dimensional precision.

4. The centrifugal pump impeller of claim 1 further having a rear sealing ring engaged with the rear cover plate and the hub, the rear sealing ring having a ring balance hole mating against the balance hole of the rear cover plate, and an inner ring formed in teeth shape by pressing for engaging with the spindle for enhancing axial alignment of the sealing ring with the spindle and radial vertical alignment of the vane against the spindle.

5. The centrifugal pump impeller of claim 1, wherein the indent section has two radial edges forming an $\alpha$ angle centered from the spindle, the $\alpha$ angle being in the range of 10 to 30 degree.

6. A centrifugal pump impeller for mounting on a rotationable spindle to pump fluid, comprising:

a hub fixedly surrounding the spindle;

a rear cover plate engaged with the hub having a plurality of balance holes formed at selected positions;

a rear sealing ring engaged with the hub and rear cover plate having an inner ring formed in teeth shape by pressing for positioning on the hub and a plurality of ring balance holes mating against the balance holes of the rear cover plate;

a front cover plate having an inlet at a front end thereof; and a plurality of vanes engaged between the front and rear cover plate to divide a space between the front and rear cover plate in a plurality of spiral pumping passages, each vane having a front blade engaged with the front cover plate, a rear blade engaged with the rear cover plate and a blade bridged the front and rear blades; the rear blade closed to the spindle having a curved front edge making contact with the hub surface for positioning, the rear blade having a vane balance hole at the curved front edge mating against the balance hole of the rear cover plate and a positioning hole at an other end remote from the vane balance hole, the positioning hole and vane balance hole aiming to position the vane between the front and rear cover plates precisely and easily.

7. The centrifugal pump impeller of claim 6, wherein the cured front edge has a radial cutting angle closed to the blade and a radial cutting edge remote from the blade, when the vanes being positioned between the front and rear cover plates, the radial cutting angle and edge are extending radially along the spindle, and the radial cutting angle of a rear vane is close to the radial cutting edge of a front vane.

8. The centrifugal pump impeller of claim 6, wherein the rear cover plate has a outer fold rim formed by pressing for preventing corrugation happened to outer rim of the rear cover plate and to enhance rear cover plate structural strength and dimensional precision.

9. The centrifugal pump impeller of claim 6, wherein the front blade has an indent section adjacent the inlet so that when the front blade engages with the front cover plate the indent section won't protrude outside the front cover plate at the inlet portion to enable pumping fluid flowing smoothly through the inlet into the impeller without producing flow resistance and turbulence.

10. The centrifugal pump impeller of claim 9, wherein the indent section has two radial edges forming an $\alpha$ angle centered from the spindle, the $\alpha$ angle being in the range of 10 to 30 degree.

11. A centrifugal pump impeller for mounting on a rotationable spindle to pump fluid, comprising:

a hub fixedly surrounding the spindle;

a rear cover plate engaged with the hub having a plurality of balance holes formed at selected positions;

a rear sealing ring engaged with the hub and rear cover plate, a front cover plate having an inlet at a front end thereof, and a plurality of vanes engaged between the front and rear cover plate to divide a space between the front and rear cover plate in a plurality of spiral pumping passages, each vane having a front blade engaged with the front cover plate, a rear blade engaged with the rear cover plate and a blade bridged the front and rear blades;

the front blade has an indent section adjacent the inlet so that when the front blade engages with the front cover plate the indent section won't protrude outside the front cover plate at the inlet portion to enable pumping fluid flowing smoothly through the inlet into the impeller without producing flow resistance and turbulence;

the rear blade closed to the spindle having a curved front edge, a radial cutting angle and a radial cutting edge, the curved front edge edge adjacent outside surface of the hub, the radial cutting angle being closed to the blade, the radial cutting edge being remote from the blade, when the vanes being positioned between the front and rear cover plates, the curved front edge surrounding the hub at the inlet, the radial cutting angle and edge extending radically along the spindle, positioning end of a rear vane being closed to the radial cutting edge of a front vane for the vane adjacent the inlet having smooth surface.

12. The centrifugal pump impeller of claim 11, wherein the rear sealing has an inner ring having teeth formed by pressing for positioning engagement with the hub and a plurality of ring balance holes at selected locations.

13. The centrifugal pump impeller of claim 11, wherein the rear blade closed to the spindle having a curved front edge making contact with the hub surface for positioning, the rear blade having a vane balance hole at the curved front edge mating against the balance hole of the rear cover plate and a positioning hole at an other end remote from the vane balance hole, the positioning hole and vane balance hole aiming to position the vane between the front and rear cover plates precisely and easily.

14. The centrifugal pump impeller of claim 11, wherein the rear cover plate has a outer fold rim formed by pressing for preventing corrugation happened to outer rim of the rear cover plate and to enhance rear cover plate structural strength and dimensional precision.

15.The centrifugal pump impeller of claim 11, wherein the indent section has two radial edges forming an $\alpha$ angle centered from the spindle, the $\alpha$ angle being in the range of 10 to 30 degree.

* * * * *